US011274474B2

(12) United States Patent
Fuchs

(10) Patent No.: US 11,274,474 B2
(45) Date of Patent: Mar. 15, 2022

(54) MOTOR VEHICLE LOCK

(71) Applicant: Kiekert Aktiengesellschaft, Heiligenhaus (DE)

(72) Inventor: Carsten Fuchs, Dusseldorf (DE)

(73) Assignee: Kiekert AG, Heiligenhaus (DE)

( * ) Notice: Subject to any disclaimer, the term of this patent is extended or adjusted under 35 U.S.C. 154(b) by 170 days.

(21) Appl. No.: 15/311,013

(22) PCT Filed: May 8, 2015

(86) PCT No.: PCT/DE2015/000222
§ 371 (c)(1),
(2) Date: Dec. 23, 2016

(87) PCT Pub. No.: WO2015/172761
PCT Pub. Date: Nov. 19, 2015

(65) Prior Publication Data

US 2017/0114576 A1 Apr. 27, 2017

(30) Foreign Application Priority Data

May 12, 2014 (DE) ..... 10 2014 006 745.9

(51) Int. Cl.
*E05B 77/04* (2014.01)
*E05B 77/54* (2014.01)
(Continued)

(52) U.S. Cl.
CPC ..... *E05B 77/54* (2013.01); *E05B 77/40* (2013.01); *E05B 81/06* (2013.01); *E05B 81/14* (2013.01);
(Continued)

(58) Field of Classification Search
CPC ..... E05B 77/54; E05B 81/06; E05B 77/40; E05B 81/64; E05B 81/14; E05B 81/34
See application file for complete search history.

(56) References Cited

U.S. PATENT DOCUMENTS 5,909,918 A 6/1999 Kowalewski et al.
6,729,072 B1 * 5/2004 Somnay ..... B60J 5/06 292/144
(Continued)

FOREIGN PATENT DOCUMENTS

DE 196 50 826 A1 6/1998
DE 20 2012 001960 U1 5/2013
(Continued)

OTHER PUBLICATIONS

International Search Report and Written Opinion for corresponding Patent Application No. PCT/DE2015/000222 dated Sep. 28, 2015.

*Primary Examiner* — Kristina R Fulton
*Assistant Examiner* — Thomas L Neubauer
(74) *Attorney, Agent, or Firm* — Renner, Otto, Boisselle & Sklar, LLP

(57) ABSTRACT

The aim of the invention is to provide a lock for a motor vehicle, whereby the accidental opening of said lock is prevented. To achieve this aim, a lock comprises a locking mechanism with a rotary latch and a locking pawl for arresting the rotary latch in a latch position. In order to open the lock with minimum effort, an electric drive (1) is provided by means of which drive the locking pawl can be moved directly or indirectly out of its locking position. The lock is further provided with a movable blocking pawl (2), which can impede the electric drive (1) from opening the lock. For the locking mechanism to be electrically opened, the blocking pawl (2) needs to be moved out of its blocking position and the electric drive (1) needs be to actuated.

8 Claims, 2 Drawing Sheets

Figure 1:
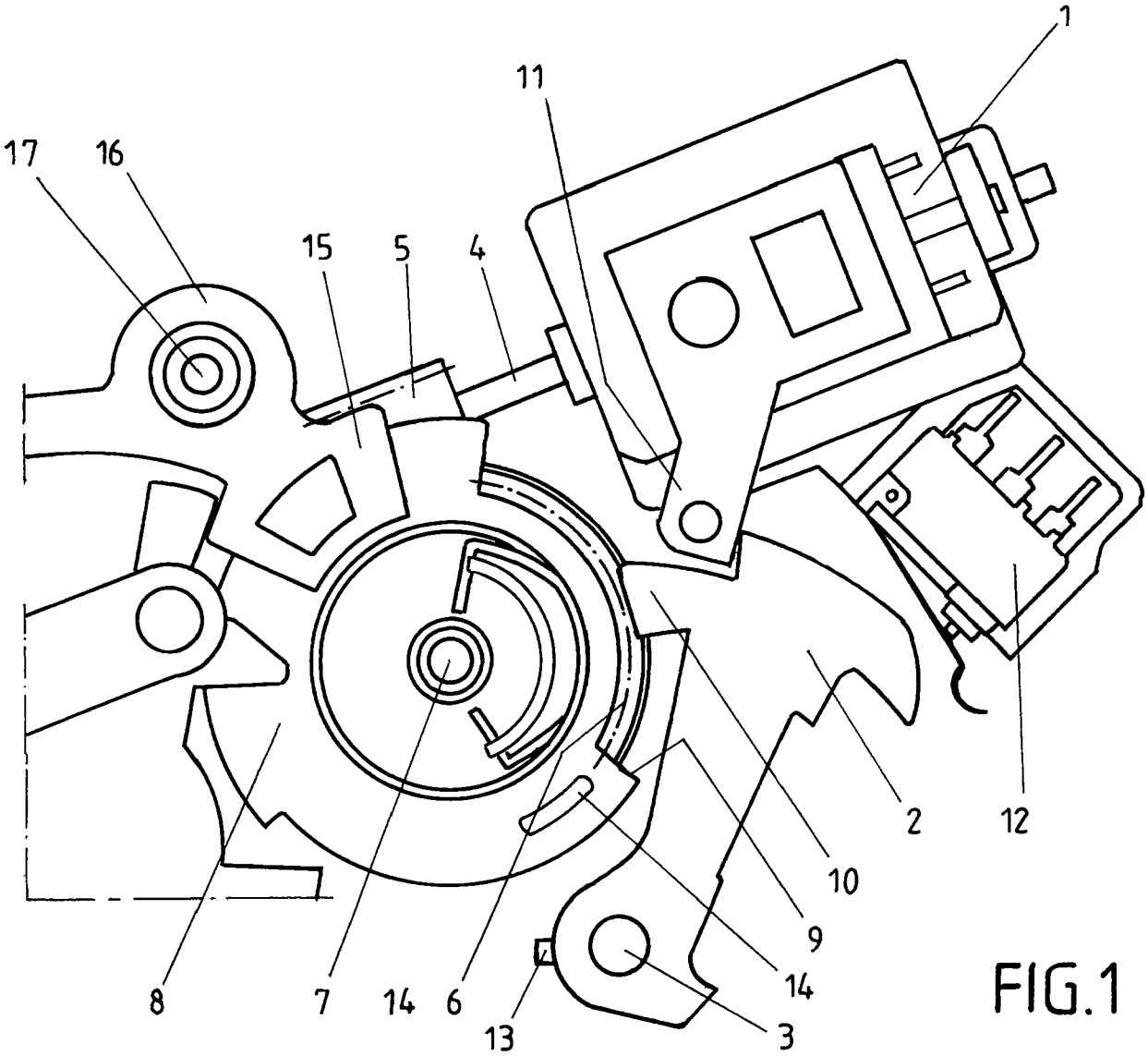

(51) Int. Cl.

| | |
|---|---|
| ***E05B 81/06*** | (2014.01) |
| ***E05B 77/40*** | (2014.01) |
| ***E05B 81/14*** | (2014.01) |
| ***E05B 81/34*** | (2014.01) |
| ***E05B 81/64*** | (2014.01) |
| ***E05B 81/56*** | (2014.01) |

(52) U.S. Cl.
CPC ..... *E05B 81/34* (2013.01); *E05B 81/56* (2013.01); *E05B 81/64* (2013.01)

(56) References Cited

U.S. PATENT DOCUMENTS

| | | | | |
|---|---|---|---|---|
| 8,141,916 | B2 * | 3/2012 | Tomaszewski | E05B 81/18 292/201 |
| 10,072,445 | B2 * | 9/2018 | Barmscheidt | E05B 85/243 |
| 2004/0232707 | A1 * | 11/2004 | Kachouh | E05B 77/28 292/216 |
| 2008/0203737 | A1 * | 8/2008 | Tomaszewski | E05B 77/26 292/216 |
| 2013/0300133 | A1 * | 11/2013 | Margheritti | E05B 77/34 292/100 |

FOREIGN PATENT DOCUMENTS

| | | | |
|---|---|---|---|
| DE | 20 2012 001961 | U1 | 5/2013 |
| DE | 10 2012 003743 | A1 | 8/2013 |
| EP | 1 503 012 | A1 | 2/2005 |

* cited by examiner

MOTOR VEHICLE LOCK

The invention relates to an electrical latch for a motor vehicle with a locking mechanism. A locking mechanism comprises a rotatable catch for the mounting of a locking bolt. The locking mechanism further has a pawl with which the catch can be latched. The metallic and/or plastic parts of the locking mechanism are generally pivotably or rotatably mounted on a latch plate which is made of metal in general.

The catch of a motor vehicle latch normally has a fork-shaped inlet slot formed by a load arm and a catching arm, into which the locking bolt of a motor vehicle door or a flap, for example a bonnet or a trunk lid enters when the door or flap is closed. The locking bolt then rotates the catch from an open position to a closed position. If the catch has reached the closed position, it is latched via the pawl in this position. The locking bolt can then no longer leave the inlet slot of the catch. In the ratchet position, a ratchet surface, also known as a locking surface, of the catch is pressed against a ratchet surface of the pawl. The pawl is therefore subjected to contact pressure in its ratchet position. This contact pressure needs to be overcome in order to move the pawl out of its ratchet position.

In order to open the locking mechanism, the pawl is moved directly or indirectly out of its ratchet position by activation of an activation device. An activation device can incorporate a handle which is pivotable for activation, for example. A pivoting movement of the handle is transmitted to a triggering lever via a rod, a lever chain or a Bowden cable. If the triggering lever is pivoted in this manner, the pawl is directly or indirectly moved out of its ratchet position and the locking mechanism opens.

In order to minimize the mechanical force necessary for opening of the door or flap, there are latches in which the catch is capable of initiating an opening moment into the pawl in the ratcheted state. As a result of this opening moment, the pawl can move out of its ratchet position independently without external force needing to be applied to overcome the aforementioned contact pressure. There is then a blocking lever which blocks the pawl in the ratcheted state of the locking mechanism. A blocking surface of the pawl then also exerts contact pressure on a blocking surface of the blocking lever. However, this contact pressure is comparatively low. In order to open the locking mechanism, the blocking lever can therefore be moved out of its blocking position with relatively little force. If the blocking lever has been moved out of its blocking position, the pawl then moves independently out of its ratchet position due to the opening moment. The catch can now move into its opening position.

In order to minimize the mechanical force necessary to open the door, there are latches with an electrical drive with which the pawl is moved out of its ratchet position. The electrical drive can be manually started by pivoting of a handle of the activation device. Such a so-called electrical latch is known from publication DE 196 50 826 A1.

Due to an electrical defect, an electrical latch could open in an unscheduled manner, resulting in a safety risk for the occupants of a motor vehicle.

It is the task of the invention to create a latch which prevents it being able to be opened in an unscheduled manner.

In order to solve the task, a latch comprises the characteristics of the first claim. Advantageous designs are stated in the sub-claims. Insofar as not specified otherwise hereinafter, the stressed object can have the aforementioned characteristics individually or in any combination.

The latch according to the claim comprises a locking mechanism with a catch and a pawl for ratcheting of the catch in a ratchet position. In order to be able to open the latch, there is an electrical drive with which the pawl can be directly or indirectly moved out of its ratchet position. Furthermore, there is a movable, in particular a rotatable blocking pawl which is capable of preventing the electrical drive opening the latch. For electrical opening of the locking mechanism, it is necessary to start the electrical drive and to move the blocking pawl from its blocking position into its non-blocking position.

As the blocking pawl does not need to ratchet a catch like a pawl and is therefore not subjected to any or at least not subjected to high contact pressure in its blocking position, it can be moved out of its blocking position with little force, for example, manually by activation of a handle of an activation device. The latch can therefore be opened in a scheduled manner with little force. The blocking pawl prevents the latch being able to be opened in an unscheduled manner in the case of an electrical defect which starts the electrical drive. The blocking pawl thus increases safety without having to accept a considerably higher manual force for the scheduled opening of a latch.

In an advantageous design of the invention, the blocking pawl is not subjected to any contact pressure when it is in its blocking position. The blocking pawl can then be manually moved out of its blocking position with especially low force. Overall, the latch can then be opened especially easily in a scheduled manner by activation of the activation device.

In one design of the invention, the electrical drive, for example an electromotor with a worm gear attached to the motor shaft can move a drive element, especially a wheel, a gear wheel and/or a disk, for opening of the locking mechanism. In its blocking position, the blocking pawl reaches into a recess of the drive element and blocks or limits such a movement of the drive element, by means of which the locking mechanism can be opened in an electrically driven manner. Reaching into a recess requires no contact pressure, so that the blocking pawl can be moved out of its blocking position with especially little force.

In one design of the invention, the drive element is part of a gearbox. The drive element thus fulfills a dual function, so that the latch can be produced with a small number of parts and consequently with little technical expense and little construction space requirements.

In one design of the invention, there is a stop for the blocking pawl which is capable of restricting movement of the blocking pawl into its blocking position. The blocking pawl is thus prevented from initiating a damaging impulse in the mechanically sensitive areas of a drive chain present for electrical opening by moving into its blocking position. By means of the stop, mechanically sensitive parts can thus be protected from damage.

In one design of the invention, the stop is designed as an attenuating element which has a yielding, especially elastic, surface. Noises are thus prevented when the blocking pawl is moved into its blocking position. For example, the surface of the stop is made of plastic, in particular an elastomer.

In one design of the invention, the stop is attached to the housing of the electromotor which is part of the electrical drive. The housing of the electromotor can be mounted robustly enough in order to be suitable as a mounting for the stop. Manufacture with little construction space is thus also possible.

In one design, there is a microswitch or a sensor which is activated by the blocking pawl as soon as the blocking pawl has been moved out of its blocking position. In one design, the electrical drive is started by the microswitch or the sensor for opening of the locking mechanism. The blocking pawl thus fulfills a dual function. On the one hand, it can prevent unscheduled electrical opening of the locking mechanism. On the other hand, it starts the drive for scheduled opening of the locking mechanism.

The object of the present invention is also a drive as described inter alia in the claims for a latch with a locking mechanism comprising a catch, pawl, optionally a blocking lever and optionally a triggering lever. The right is reserved to stress protection only for the drive independently of the latch with the locking mechanism. A triggering lever for opening of the locking mechanism can then be part of the drive.

The blocking pawl is preferably removed or moved away from the engagement area of the disk manually. This offers the advantage that in the case of erroneous feeding of the electromotor a mechanical stop in the form of a blocking pawl is present which prevents unintentional opening of the latch. The blocking contour of the blocking pawl is moved on by means of an internal activation or an external activation to open the latch, i.e. internal handle or external handle on the motor vehicle.

Figure 2:
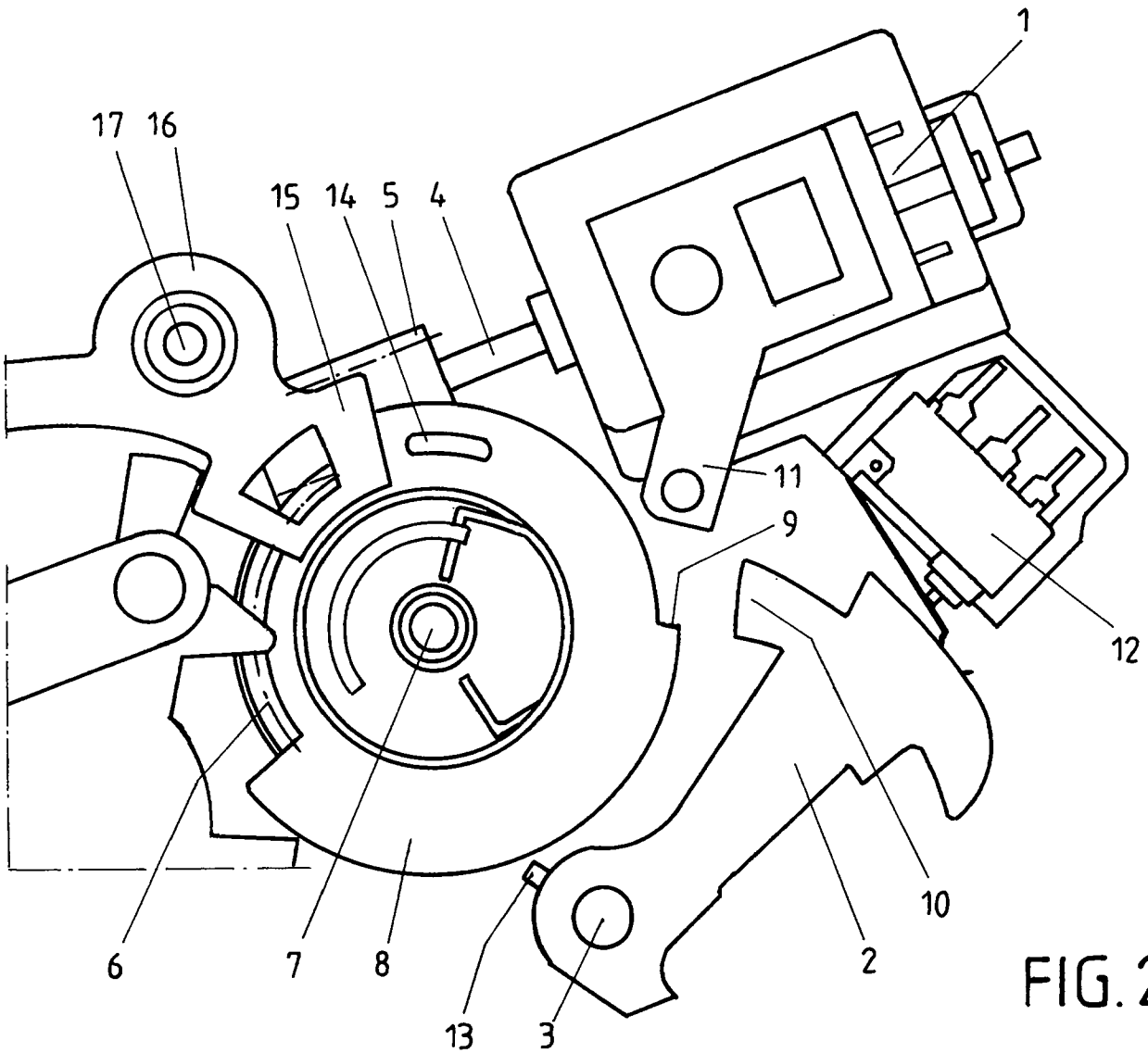

The following are shown:

FIG. 1: Drive for electrical opening of a latch with a blocking pawl in the blocking position;

FIG. 2: Drive for electrical opening of a latch with a blocking pawl in the non-blocking position;

FIGS. 1 and 2 show a drive for electrical opening of a motor vehicle latch. In order to be able to open the latch with little force, the drive comprises an electromotor 1 with which the locking mechanism of the catch can be opened in an electrically driven manner. There is a pivotably mounted blocking pawl 2 which prevents the electrical drive or the electromotor 1 from electrically opening in its blocking position shown in FIG. 1. The blocking pawl 2 can be rotated around its axis 3.

A worm gear 5 is attached to the motor shaft 4 of the electromotor 1. By rotating the shaft 4 and thus by rotating the worm gear 5 a rotatable gear wheel 6 is rotated around its axis 7 into which the worm gear 5 engages. A disk 8 is attached to the gear wheel 7. In its blocking position, a protrusion 10 of the blocking pawl 2 reaches into a recess 9 of the disk 8 and thus limits a rotational movement of the gear wheel 6 and the disk 8 in an anti-clockwise direction, by means of which the locking mechanism of the latch could be opened in an electrically driven manner. Reaching into a recess 9 requires no contact pressure. Consequently, the blocking pawl 2 can be moved out of its blocking position with especially little force. The blocking pawl 2 is therefore also predominantly not subjected to any contact pressure in its blocking position.

The worm gear 5 and the gear wheel 6 form a gearbox. The drive element in the form of the gear wheel 6 with the disk 8 thus fulfills a dual function. The gear wheel 6 and the disk 8 can be designed as a single component or multiple components.

There is a stop 11 for the blocking pawl 2 which is capable of restricting movement of the blocking pawl 2 in its blocking position. This is illustrated in FIG. 1. The blocking pawl is thus prevented from initiating a damaging impulse into the disk 8 with the gear wheel 6, i.e. in mechanically sensitive areas of a drive chain, by moving into its blocking position.

The stop 11 can be designed as an attenuating element which has an elastic surface. In this execution example, the stop 11 is attached to the housing of the electromotor 1.

There is a microswitch 12 which is activated by the blocking pawl 2 as shown in FIG. 2, as soon as the blocking pawl 2 is in its non-blocking position. By means of the microswitch 12 the electromotor 1 is then started for opening of the locking mechanism. The blocking pawl 2 thus fulfills a dual function.

The blocking pawl 2 furthermore comprises a protrusion 13 which is adjacent to the disk 8 when the blocking pawl 2 is in its non-blocking position as illustrated in FIG. 2. The protrusion 13 limits the pivoting movement of the blocking pawl 2 into its non-blocking position.

If, starting from the position shown in the Figure, the blocking pawl 2 is pivoted around its axis 3 in a clockwise direction, it ultimately activates the microswitch 12. This starts the electromotor 1. As a consequence hereof, the gear wheel 6 and thus also the disk 8 are rotated in an anti-clockwise direction. A tappet 14 of the disk 8 ultimately grasps an arm 15 of a pivotably located triggering lever 16 and pivots it around its axis 17 in a clockwise direction. As a result, the pawl of the latch locking mechanism is moved out of its ratchet position and the latch is thus opened.

REFERENCE SIGN LIST

1: Electromotor
2: Blocking pawl
3: Axis of the blocking pawl
4: shaft of the electromotor
5: Worm gear on the motor shaft
6: Gear wheel
7: Axis of the gear wheel
8: Disk
9: Recess
10: Protrusion of the blocking pawl
11: Stop for the blocking pawl
12: Microswitch
13: Protrusion of the blocking pawl
14: Tappet
15: Triggering lever arm
16: Triggering lever
17: Axis of the triggering lever

The invention claimed is:

1. A locking mechanism having an open position and a ratchet position;

an electrical drive for opening the locking mechanism, the electrical drive having a rotatable gear wheel with which the locking mechanism is moveable out of the ratchet position and having an electromotor within an electromotor housing;

a blocking pawl having a blocking position in which the blocking pawl directly contacts the rotatable gear wheel to limit rotational movement of the rotatable gear wheel, whereby the locking mechanism is prevented from moving out of the ratchet position; and an elastomeric stop that is directly fixed in position to the electromotor housing of the electromotor of the electrical drive, wherein the blocking pawl is movable relative to the elastomeric stop to engage and disengage the elastomeric stop, the elastomeric stop having a stop surface that is configured to be engaged by the blocking pawl for restricting the movement of the blocking pawl in the blocking position, wherein during movement of the blocking pawl from the blocking position to a non-blocking position, the blocking pawl both mechanically activates the electrical drive and is moved out of direct contact with the rotatable gear wheel and the elastomeric stop to enable rotation of the rotatable gear wheel that moves the pawl out of the ratchet position.

2. The latch according to claim 1, wherein the blocking pawl is not engaged with the locking mechanism when in the blocking position.

3. The latch according to claim 1, wherein the gear wheel has a recess defined along a peripheral surface of the gear wheel and the blocking pawl reaches into the recess of the gear wheel in the blocking position.

4. The latch according to claim 3, wherein the gear wheel is part of a gearbox.

5. The latch according to claim 1, wherein the resilient elastomeric stop is made of plastic.

6. The latch according to claim 1 further comprising a sensor that is in communication with the electrical drive which is activated by the blocking pawl directly contacting the sensor during movement of the blocking pawl to the non-blocking position.

7. The latch according to claim 6, wherein the sensor is a microswitch.

8. The latch according to claim 1 further comprising a triggering lever that is pivoted by the electrical drive to open the locking mechanism.

* * * * *